US005293142A

United States Patent [19]

Fello et al.

[11] Patent Number: 5,293,142

[45] Date of Patent: Mar. 8, 1994

[54] GROUND FAULT CIRCUIT BREAKER WITH FLAT BUS BARS FOR SENSING COILS

[75] Inventors: Joseph P. Fello, Penn Hills Township, Allegheny County; Michael J. Whipple, New Sewickley; William E. Smith, New Brighton; Wilbert E. Lindsay, Robinson, all of Pa.

[73] Assignee: Westinghouse Electric Corp., Pittsburgh, Pa.

[21] Appl. No.: 943,670

[22] Filed: Sep. 11, 1992

[51] Int. Cl.[5] ..... H01H 73/00

[52] U.S. Cl. ..... 335/18; 361/42

[58] Field of Search ..... 335/18; 361/42–48

[56] References Cited

U.S. PATENT DOCUMENTS 4,667,263 5/1987 Morris et al. ..... 361/42

5,179,491 1/1993 Runyan ..... 361/45

*Primary Examiner*—Lincoln Donovan

*Attorney, Agent, or Firm*—M. J. Moran

[57] ABSTRACT

A ground fault circuit breaker has line and neutral bus bars extending through the center apertures of two laterally spaced toroidal coils to form the primaries of ground fault sensing transformers. The bus bars have flat center sections extending between the two coils parallel to the coil end faces and offset laterally by flat laterally extending legs at each end which are bent transverse to the end faces of the coils and extend through the coil apertures in flat confronting relation. The leg on one end of the neutral bus bar has a terminal portion bent into a plane parallel to the center section with a crimp at the end for attachment to a neutral pigtail.

13 Claims, 4 Drawing Sheets

GROUND FAULT CIRCUIT BREAKER WITH FLAT BUS BARS FOR SENSING COILS

CROSS REFERENCE TO RELATED APPLICATIONS

U.S. Ser. No. 07/676,150, filed on Mar. 27, 1991 and entitled DUAL WOUND TRIP SOLENOID.

Commonly owned U.S. patent application Ser. No. 943,803 entitled CIRCUIT BREAKER WITH AUXILIARY SWITCH ACTUATED BY CASCADED ACTUATING MEMBERS concurrently filed in the names of Joseph P. Fello and Michael J. Whipple; U.S. patent application Ser. No. 943,796 entitled INSULATING BARRIERS FOR CIRCUIT BREAKER BUS BARS AND A GROUND FAULT CIRCUIT BREAKER INCORPORATING SAME concurrently filed in the names of Michael J. Whipple and Joseph P. Fello; and U.S. patent application Ser. No. 943,801 entitled GROUND FAULT CIRCUIT BREAKER WITH TEST SPRING/CONTACTS DIRECTLY MOUNTED TO TEST CIRCUIT OF PRINTED CIRCUIT BOARD concurrently filed in the names of Joseph P. Fello, Michael J. Whipple, Umesh C. Patel and Garry B. Theadore.

BACKGROUND OF THE INVENTION

1. Field of the Invention

This invention relates to circuit breakers with ground fault protection, and more particularly, to small circuit breakers with toroidal sensing coils through which the power and neutral leads are passed to sense ground faults. Specifically, the invention is directed to bus bars for carrying higher currents through the sensing coils.

2. Background Information

There is increasing demand today to provide ground fault protection in circuit breakers, including the small circuit breakers typically used in residential and light industrial and commercial applications. The physical dimensions of the molded casings for such circuit breakers are constrained by the standardized openings in the enclosures and cabinets in which such circuit breakers are mounted. Thus, there is little room within the molded casing of such circuit breakers for adding the components necessary to provide the ground fault protection.

Common ground fault protection circuits include flat toroidal sensing coils through which the power and neutral leads pass to form transformers. Electronics connected to the sensing coils detect ground fault currents and energize a trip coil which trips the circuit breaker. The limited space available within the circuit breaker molded case restricts the size of the sensing coils that can be used. This in turn limits the size of the power and neutral leads which must pass through the central aperture of the toroidal sensing coils, and therefore limits the current rating of the circuit breaker. The problem is compounded in circuit breakers which provide neutral to ground fault protection as well as power lead to ground fault protection. These latter circuit breakers require two sensing coils in a commonly used ground fault protection circuit. Typically, these two flat toroidal coils have been mounted side by side within the circuit breaker molded housing which requires that the neutral and power leads bend 90° after passing through the coil in order to bridge the gap between the two sensing coils. This increases the overall thickness of the assembly, and hence the space required within the molded housing.

There is a known ground fault circuit breaker in which the two sensing coils are stacked in spaced relation with straight bus bars extending along the aligned axes through the coils. However, this makes the assembly wider.

There is a need therefore for a circuit breaker with ground fault protection having an increased current rating, yet of a physical size which can be contained within the standard size molded housing.

SUMMARY OF THE INVENTION

This need and others are satisfied by the invention which is directed to a circuit breaker with ground fault protection in which the power and neutral leads which pass through the ground fault sensing coils are in the form of flat bus bars. These flat bus bars have an outer section extending parallel to the end face of the toroidal sensing coil and an end section extending laterally from the center section and bent transverse thereto to extend through the central aperture in the toroidal sensing coil. The flat bus bars for the power lead and neutral lead have the end sections extending laterally from opposite sides of the conducting sections and bent in flat confronting relation to pass through the central aperture in the toroidal coil. This laterally spaces the center sections of the bus bars.

Preferably, confronting additional end sections extend laterally from the opposite end of the center section of each bus bar and are bent into flat confronting relation to each other. These section end sections can extend through a second toroidal sensing coil in circuit breakers which also provide neutral to ground fault protection.

One end section of the neutral bus bar has a terminal portion with a crimp at the end for securing the bus bar to a neutral pigtail. Preferably, the terminal portion is bent transverse to the end section so that it is substantially parallel to the flat center section. Where the routing of the pigtail makes it desirable, the crimped end can be angled in the plane of the flat terminal portion of the end section of the neutral bus bar. In circuit breakers which have line to ground fault protection, but not neutral to ground fault protection, and therefore only one toroidal coil, the crimp for connection to the neutral pigtail can be provided on either end of the neutral bus bar, but is preferably provided on the end which is not passed through the single toroidal coil.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be shown as applied to a single pole residential or light commercial or industrial ground fault circuit breaker; however, it will be evident to those skilled in the art that the invention is also applicable to multi-pole circuit breakers as well.

Figure 1:
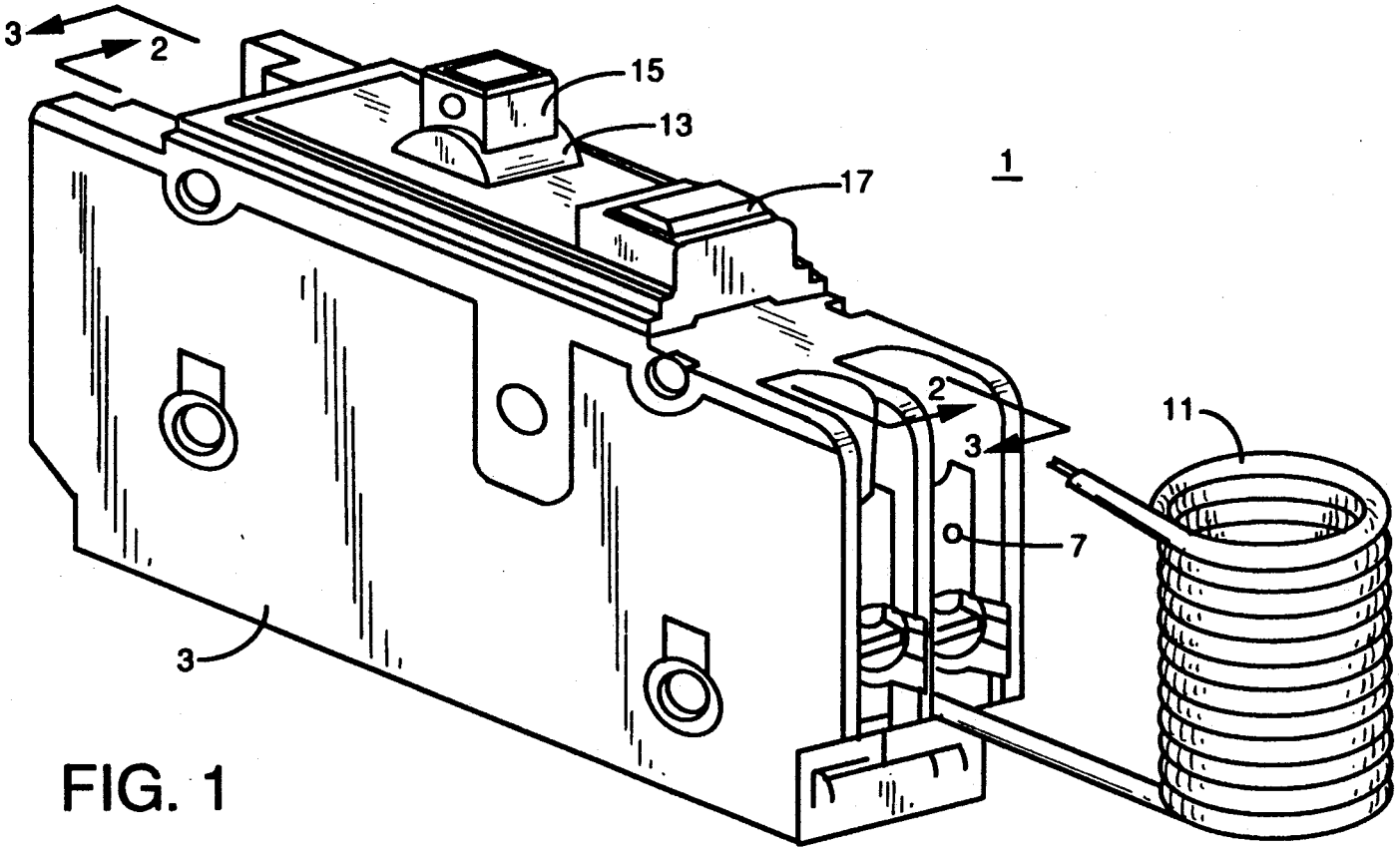
FIG. 1 is an isometric view of a ground fault circuit breaker to which the invention has been applied.

Referring to FIG. 1, the ground fault circuit breaker 1 comprises a housing 3 which is composed of electrically insulating material such a thermo-setting resin. A load terminal 5 and load neutral terminal 7 are provided for connecting the circuit breaker to a load. A line terminal 9 (see FIG. 2) is provided at the opposite end of the housing 3 for connection to a commercial power system. The line side of the neutral is connected to a pigtail 11. The ground fault circuit breaker 1 includes an operating member 13 having an integral molded handle 15 extending through the housing 3. A ground fault test switch 17 is also accessible through the housing.

Figure 2:
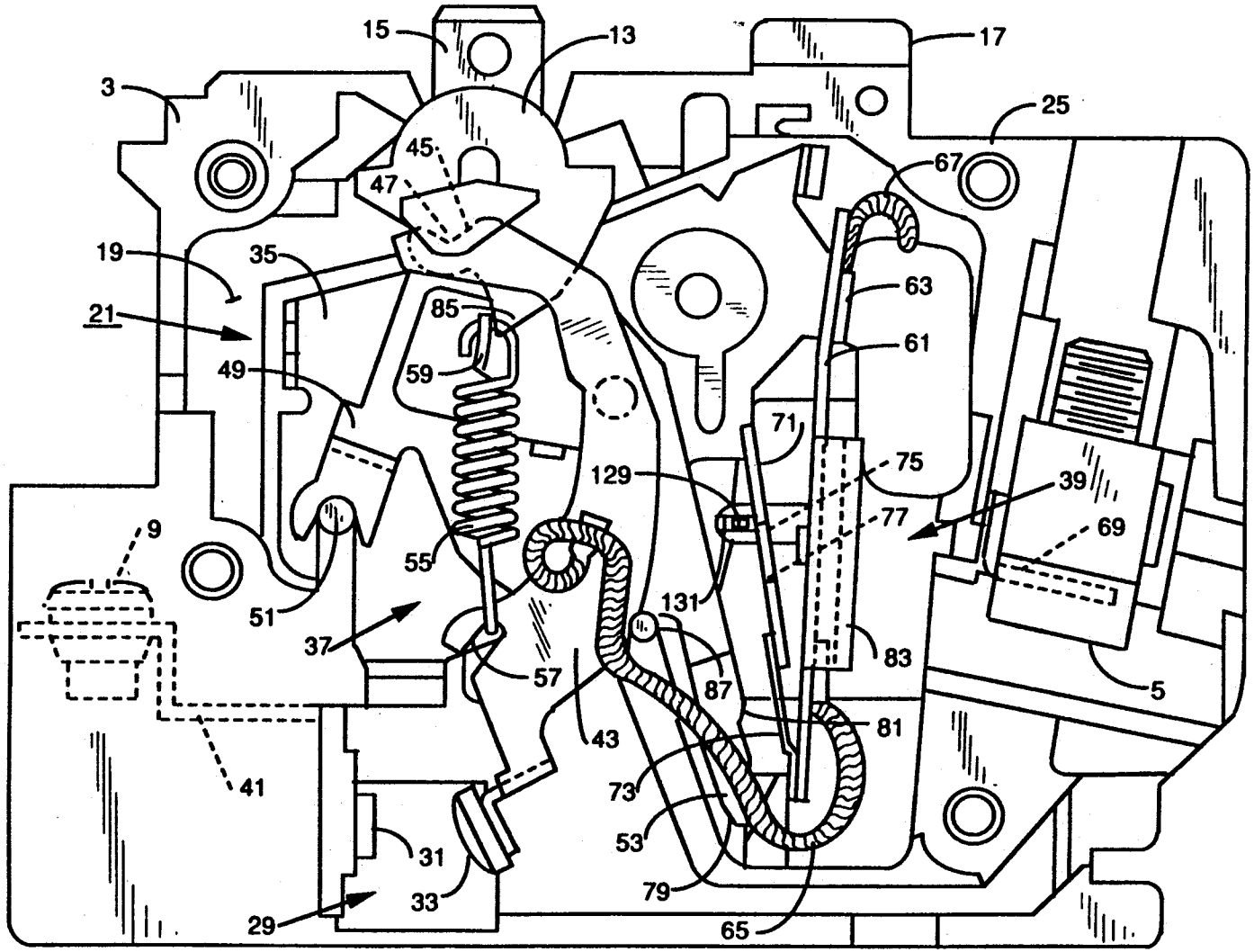
FIG. 2 is a vertical section taken along the line 2—2 through the circuit breaker of FIG. 1.
Figure 3:
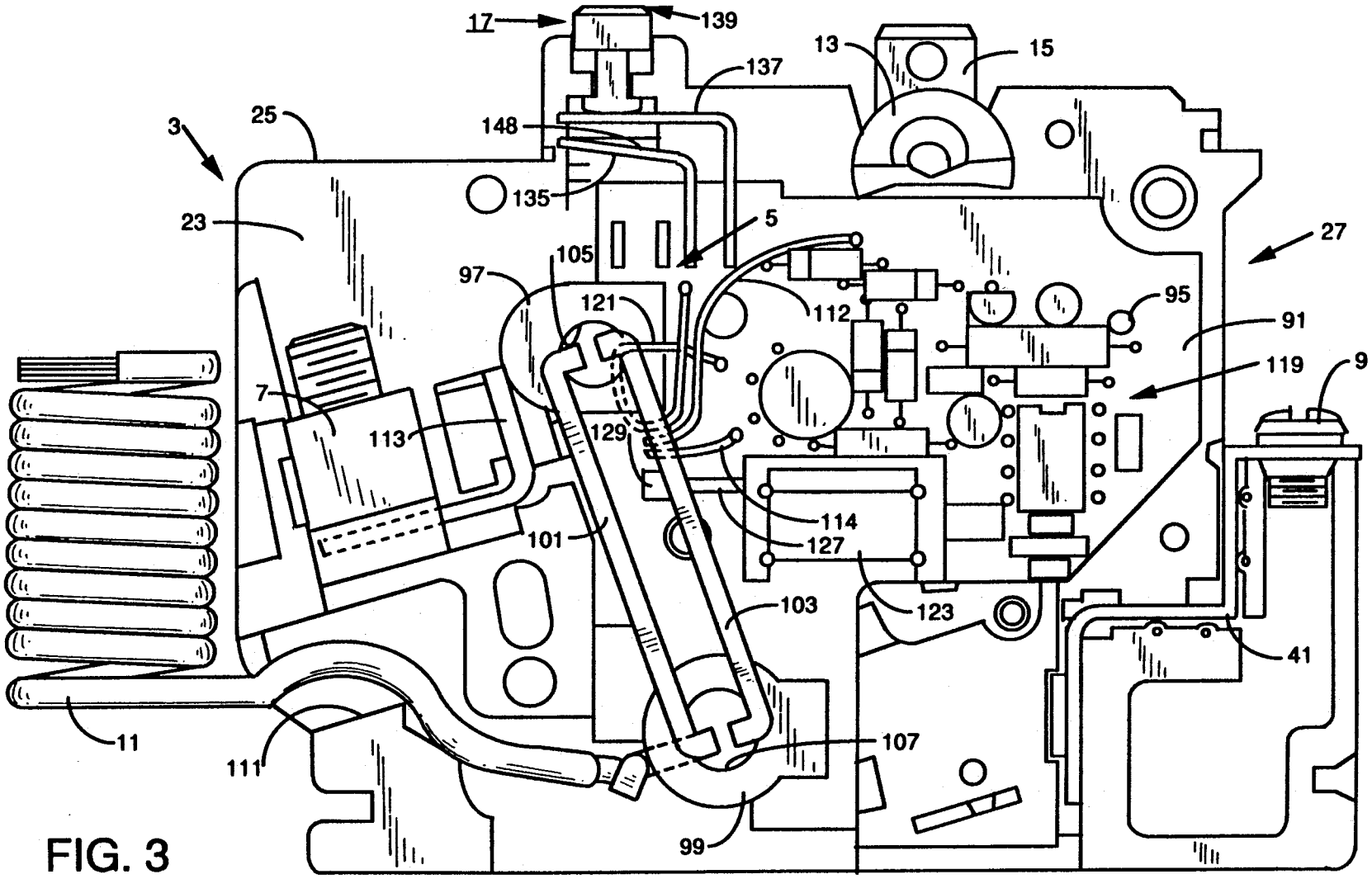
FIG. 3 is another vertical section through the circuit breaker of FIG. 1 taken along line 3—3.

The housing 3 defines a compartment 19 (see FIG. 2) in which a circuit breaker mechanism 21 is housed, and a second compartment 23, separated from the compartment 19 by a center panel 25, which houses a ground fault circuit interrupter 27 (see FIG. 3).

The circuit breaker mechanism 21 is of the type disclosed in U.S. Pat. No. 3,566,318 which is hereby incorporated by reference for a complete description of the structure and its operation. Briefly, the circuit breaker mechanism 21 includes a pair of separable contacts 29, including a fixed contact 31 and a movable contact 33, a supporting metal frame 35, an operating mechanism 37, and a trip device 39. The fixed contact 31 is connected by a conductor 41 to the line terminal 9.

The operating mechanism 37 includes a flat electrically conductive generally C-shaped contact arm 43 to which the movable contact 33 is secured at the lower end. The upper end of the contact arm has a notch 45 which is biased against a projection 47 on the operating member 13 in a manner to be discussed. The operating member 37 is mounted in the housing 3 for rotation about an axis perpendicular to the plane of FIG. 2. Motion is transmitted from the operating member 13 to the contact arm 43 when the circuit breaker 1 is manually operated, and from the contact arm 43 to the operating member 13 when the breaker is automatically tripped.

The operating mechanism 37 further includes a latchable cradle 49 which is pivotally supported at one end by a pivot 51 molded into the center panel 25. The other end 53 of the cradle 49 is latched by the trip device 39 in a manner to be discussed.

As more specifically described in U.S. Pat. No. 3,254,176, the ends of the latchable cradle 49 are offset and disposed along a plane which is parallel to a plane in which the main body portion of the latchable cradle 49 is disposed. This places the ends of the cradle 49 in the same plane as the C-shaped contact arm 43. A spring 55 is connected, under tension, at one end in a slot 57 near the lower end of the C-shaped contact arm 43, and at the other end to a bent over tab 59 projecting outward from the main body of the latchable cradle 49.

The trip device 39 includes a bimetal 61 secured at an upper end to a bent over tab 63 on the frame 35. The contact arm 43 of the operating mechanism 37 is connected to the lower end of the bimetal 61 by a flexible conductor 65. The upper end of the bimetal 61 is connected by another flexible conductor 67 to the ground fault detector discussed below which in turn is connected to a tang 69 extending through an opening in the end wall of the housing 3. The load terminal 5 is connected to the external end of the tang 69 for connection of the circuit breaker to a load. The closed circuit through the circuit breaker 1 extends from the line terminal 9, conductor 41, fixed contact 31, movable contact 33, contact arm 43, flexible conductor 65, bimetal 61, flexible conductor 67, the ground fault detector, tang 69, and load terminal 5.

The trip device 39 further includes an elongated, rigid magnetic armature or latch member 71 mounted on a spring 73 which is welded to the free lower end of the bimetal 61. The magnetic armature 71 extends generally upward along side the bimetal 61, and has an opening 75 forming a latch surface 77 at the base of the opening. The latch end 53 of the cradle 49 is formed with a latch surface 79 and a stop surface or fulcrum part 81. The armature 71 serves as a stop to engage the fulcrum part 81 of the latchable cradle 49 in the latched position of the cradle. A U-shaped magnetic member 83 is secured to the bimetal 61 adjacent the magnetic armature 71 to concentrate the flux created by current flowing through the bimetal.

The circuit breaker is shown in FIG. 2 in the tripped position. The cradle 49 is latched for resetting the circuit breaker by rotating the handle 15 clockwise, as shown in FIG. 2. This causes a projection 85 on the operating member 13 to engage the tab 59 and rotate the latchable cradle 49 in the counterclockwise direction until the latch end 53 is latched in the opening 75 in the magnetic armature 71. This operation is shown in detail in U.S. Pat. No. 3,566,318.

The separable contacts 29 are closed by moving the handle 15, with the cradle 49 latched, in the counterclockwise direction as viewed in FIG. 2 to the on position. This causes the projection 47 on the operating member 13 which engages the notch 45 in the contact arm 43 to move the upper end of the contact arm to the right of the line of action of the spring 55 resulting in closure of the contacts 29. The contacts 29 could be manually opened from this closed position by rotating the handle 15 clockwise, as viewed in FIG. 2, to the off position.

The trip device 39 provides overcurrent protection through the bimetal 61. Prolonged current above the rated current of the circuit breaker heats the bimetal 61 causing the lower end to deflect to the right, as shown in FIG. 2, thereby unlatching the cradle 49, as the armature 71 pivots about the fulcrum 81 until the latch surface 79 on the latch end 53 of the cradle slides off of the latch surface 77. When unlatched, the cradle 49 is rotated clockwise by the spring 55 until it engages a stop pin 87 molded in the center panel 25 of the circuit breaker housing. During this movement, the line of action of the spring 55 moves to the right of the pivot formed by the notch 45 in the contact arm and the projection 47 on the operating member 13, whereupon the spring 55 biases the contact arm 43 in the opening direction to open the contacts 29 and moves the contact arm 43 so that the line of action of the force exerted by the spring on the operating member 13 shifts across the rotational axis of the operating member 13 and actuates the operating member to the tripped position shown in FIG. 2. The tripped position of the operating member 13 is intermediate the "on" and "off" positions. The operating member 13 is stopped in the intermediate or tripped position seen in FIG. 2 when the projection 85 engages the tab 59 on the cradle 49. The contact arm 43 is stopped in the open position seen in FIG. 2 when it engages the stop pin 87. The circuit breaker is reset following the trip in the manner discussed above.

The trip device 39 also provides short circuit protection. The very high current through the bimetal 61 produced by a short circuit induces a magnetic flux which is concentrated by the magnetic member 83 and of sufficient magnitude to attract the armature 71 to the magnetic member, thereby unlatching the cradle 49 to trip the circuit breaker.

As discussed, the circuit breaker 1 also provides ground fault protection, both for line to ground faults and neutral to ground faults. All the components for ground fault protection are mounted on a printed circuit board 91 in the compartment 23 formed in the molded housing 3 as shown in FIG. 3. The printed circuit board 91 is positioned within the compartment 23 by a pin 95 molded into the center panel 25. A suitable ground fault protection circuit 119 is the well-known dormant oscillator-type such as disclosed in U.S. patent application Ser. No. 676,150 referred to above. This circuit includes two transformers formed by toroidal sensing coils 97 and 99. The primaries of the transformers are formed by passing a neutral conductor 101 and a line conductor 103 through the central openings 105 and 107 in the sensing coils 97 and 99, respectively.

Figure 4:
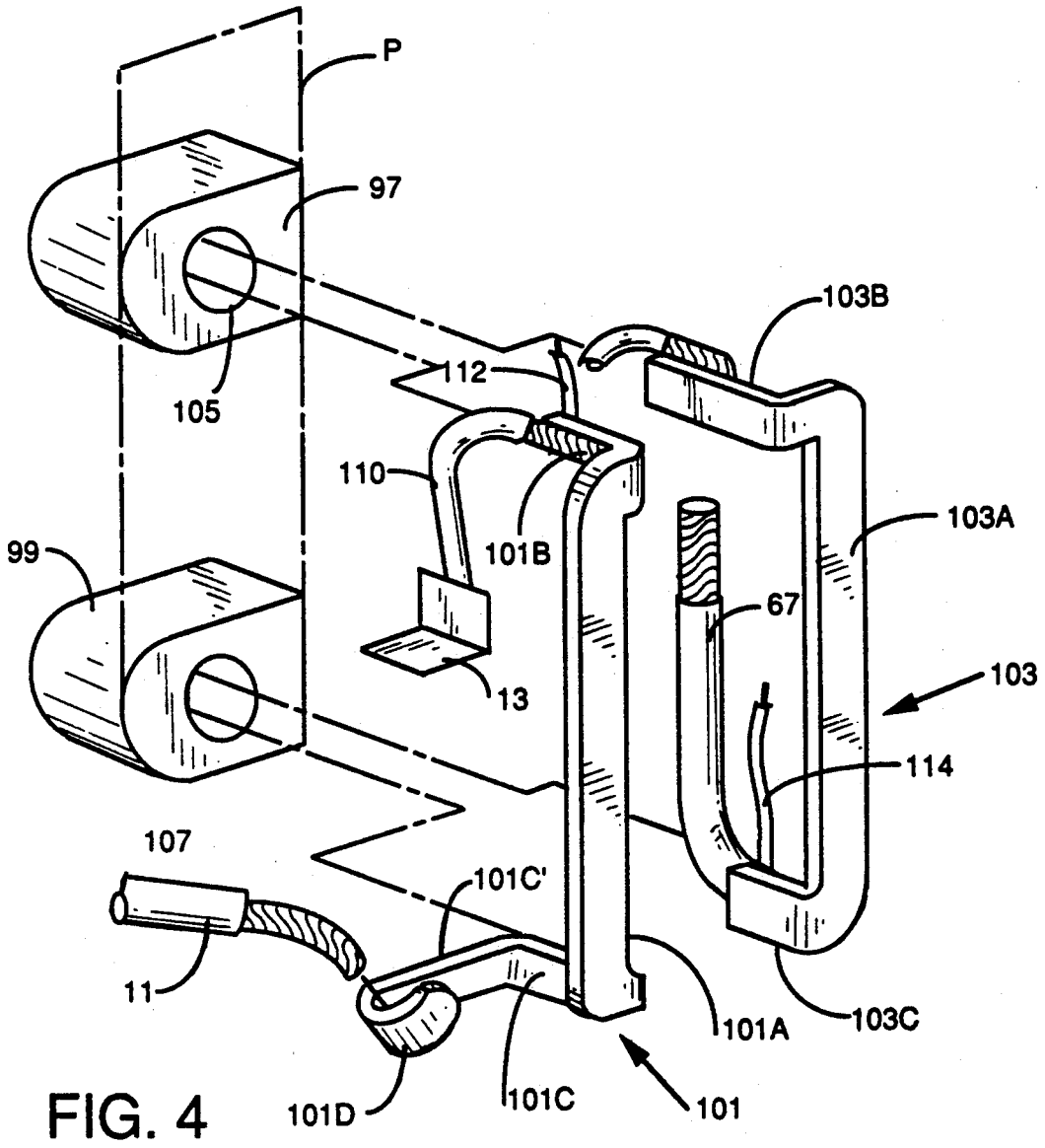
FIG. 4 is an exploded isometric view of bus bars in accordance with the invention and showing their relationship to the ground fault sensing coils.

These conductors 101 and 103 are flat bus bars formed from sheet material. As best seen in FIG. 4, the neutral bus bar 101 has a flat center section 101*a* extending parallel to a common plane P containing the end faces of the toroidal coils 97 and 99. A flat leg section 101*b* extends generally laterally from the upper end of the center section 101*a* and is bent substantially at a right angle to the flat center section. A second leg section 101*c* extends generally laterally from the lower end of the center section 101*a* and is bent transversely to the flat center section. A terminal portion 101*c'* of the leg 101*c* is bent generally perpendicular to the leg 101*c* to extend in a plane generally parallel to the plane of the flat center section 101*a*. A crimp 101*d* is formed in the end of the terminal portion of 101*c'*. Preferably, this crimp 101*d* is bent at an angle in the plane of the terminal portion 101*c'* for a purpose to be discussed.

The line bus bar 103 also has a flat center section 103*a* and a first leg section 103*b* extending generally laterally from the upper end of the center section and bent generally perpendicular to the plane of the center section 103*a*. A second leg section 103*c* extends laterally from and is bent generally perpendicular to the lower end of the flat center section 103*a*.

The upper legs 101*b* and 103*b* and the lower legs 101*c* and 103*c* extend from opposite sides of the respective center sections 101*a* and 103*a* of the neutral bus bar 101 and the line bus bar 103 so that when the two bus bars are placed side by side the flat upper leg sections 101*b* and 103*b*, and the flat lower leg sections 101*c* and 103*c*, are in spaced, flat confronting relation. The upper leg sections 101*b* and 103*b* extend through the central aperture 105 of the toroidal coil 97 while the leg sections 101*c* and 103*c* extend through the central aperture 107 in the toroidal coil 99.

The neutral and line bus bars 101 and 103 are electrically insulated from each other by, for instance, an insulating coating 104. Such an insulating coating can be provided by dipping the bus bars in an air dry insulating enamel. Other types of insulation can be used to electrically insulate the neutral and line conductors from each other and from other components within the circuit breaker.

The crimp 101*d* on the terminal portion 101*c'* of the lower leg 101*c* on the neutral bus bar 101 secures this bus bar to the neutral pigtail 11. The crimp 101*d* is bent at an angle to the terminal portion 101*c'* of the lower leg 101*c* so that the pigtail is lead directly from the crimp to the opening 111 in the housing 3. The upper leg 101*b* of the neutral conductor 101 is connected by an insulated lead 110 to a tang 113 which is secured to the load neutral terminal 7. This upper end of the neutral bus bar 101 is also connected by a lead 112 (FIG. 3) to the printed circuit board 91.

The lower end of the line bus bar 103 is connected by the flexible conductor 67 to the bimetal 61 and is also connected by a lead 114 to the printed circuit board 91. The upper end of the line bus bar 103 is connected through an opening in the central panel 23 to the tang 69 leading to the load terminal 5. The windings on the toroidal sensing coils 97 and 99 form the secondaries of the sensing transformers.

In an exemplary embodiment of the invention, the neutral bus bar 101 and line bus bar 103 are formed from copper sheet material having a thickness of 0.047 inches (1.2 mm). The center sections are 0.135 inches (3.4 mm) wide and the legs are 0.125 inches (3.175 mm) wide. With these bus bars, the circuit breaker 1 has a rated current of 50 amperes. With the prior art insulated wire used as the neutral and line conductors for the sensing transformers, the 0.220 inch (5.59 mm) diameter of the central apertures 105 and 107 of the sensing coils limit the rated current of the circuit breaker 1 to 30 amps using 10 gauge twisted wire. Thus, the bus bars of the invention allow the rating of the ground fault circuit breaker to be increased without major modification to the circuit breaker structure.

In operation, upon detection of a grounded load conductor or a grounded load neutral conductor through the toroids 97 or 99, the ground fault circuit 119 energizes a trip solenoid 123. Energization of the trip solenoid 123 results in extension of the solenoid plunger 127. A flag 129 secured to the plunger extends through a slot 131 in the center panel 25 and pushes the armature 71 to the right as viewed in FIG. 2 to trip the circuit breaker thereby opening the separable contacts 29.

In order to allow for periodic verification of the operation of the circuitry, a test circuit is provided which includes the test switch 17, accessible from the outside of the housing 3 as seen in FIG. 1. More specifically, a test wire 121 is connected between the neutral conductor 101 and the load conductor 103 by way of the test switch 17, and is routed through the toroid 97 (FIG. 3) to induce a signal in the secondary winding T1 to simulate a ground fault condition. Upon actuation of the test button 139 of the test switch 17, which closes the contacts 135 and 137, a ground condition is simulated, resulting in a trip of the circuit breaker through energization of the trip solenoid 123.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker comprising:

a power circuit and neutral circuit;

separable power contacts connected in said power circuit;

an operating mechanism for opening and closing said separable power contacts;

a trip mechanism responsive to selected current conditions in said power circuit for tripping said operating mechanism to open said separable power contacts; and ground fault interrupt means including:

a pair of toroidal sensing coils laterally spaced from each other in a common plane, each sensing coil having a coil end face and a central aperture transverse to said coil end face, said coil end face of each sensing coil being in said common plane; and a pair of flat bus bars each having a flat center section with its widest portion laying flat and in a plane extending parallel to said common plane of said coil end face of each sensing coil and between said toroidal sensing coils and offset laterally from the flat center section of the other bus bar, and flat leg sections extending generally laterally from each end of the center section and bent to extend one through each of said aperture of said toroidal sensing coils generally transverse to said common plane, and means connecting one of said flat bus bars in said power circuit and the other of said flat bus bars in said neutral circuit, and actuating means connected to said sensing coils and operative to actuate said trip mechanism in response to a ground fault in either said power circuit or said neutral circuit.

2. The circuit breaker of claim 1 wherein one leg section of said other flat bus bar connected in said neutral circuit has a terminal portion with a crimped end which secures said other bus bar in said neutral circuit.

3. The circuit breaker of claim 2 wherein said terminal portion of said other flat bus bar is bent into a plane substantially parallel to said common plane.

4. A pair of bus bars for use with a ground fault detection circuit having at least one flat toroidal sensing coil with a central aperture transverse to a coil end face, each of said bus bars including:

a flat center section extending generally parallel to said coil end face; and a flat leg section extending generally laterally from an end of said flat center section and bent generally transverse to said flat center section to extend through said central aperture, said flat leg sections extending from opposite sides of said flat center sections and bent in flat confronting relation to laterally space said flat center sections.

5. The pair of bus bars of claim 4 wherein one of said flat bus bars has another leg section extending parallel to said first mentioned leg section from another end of said center section and bent generally transverse to said flat center section and having a terminal portion with a crimp.

6. The pair of bus bars of claim 5 wherein said terminal portion of said another leg section of said one bus bar is bent transverse to said another leg section and generally parallel to said flat center section.

7. The pair of bus bars of claim 4 for use with a ground fault detection circuit including another flat toroidal sensing coil having a central aperture transverse to a coil end face and laterally spaced from said at least one toroidal sensing coil with said coil end faces substantially in a common plane, wherein said flat bus bars each include another flat leg section extending generally laterally from another end of said flat center section said another sensing coil, said another flat leg sections extending from opposite sides of said pair of flat center sections and extending through said central aperture of said another flat sensing coil in flat confronting relation.

8. The pair of flat bus bars in accordance with claim 7 wherein said another leg section of one of said flat bus bars has a terminal portion with a crimped end.

9. The pair of flat bus bars of claim 8 wherein said terminal portion of said another leg section is bent transverse to said another leg section and substantially parallel to said center section.

10. The pair of flat bus bars of claim 9 wherein said crimped end of said terminal portion of said another leg section is angled in a plane containing said terminal portion.

11. The pair of flat bus bars of claim 4, for use with a neutral pigtail wherein one flat bus bar has means adjacent another end for securing said one flat bus bar to the neutral pigtail.

12. The pair of flat bus bars of claim 11 wherein said means for securing said one flat bus bar to the neutral pigtail is a crimp.

13. The pair of flat bus bars of claim 12 said one flat bus bar has another leg section extending from said another end of said center section and bent generally transverse to said flat center section and having a terminal portion with said crimp.

* * * * *